US006092808A

United States Patent [19]

Frankel

[11] Patent Number: 6,092,808

[45] Date of Patent: Jul. 25, 2000

[54] 3-DIMENSIONAL MANIPULATIVE PUZZLE IN THE FORM OF A HUMANOID FIGURE

[76] Inventor: Joshua G. Frankel, 825 Ridge Ave., Apt. 3, Evanston, Ill. 60202

[21] Appl. No.: 08/961,178

[22] Filed: Oct. 30, 1997

Related U.S. Application Data

[60] Provisional application No. 60/030,014, Nov. 1, 1996.

[51] Int. Cl.[7] ..... A63F 9/08

[52] U.S. Cl. ..... 273/153 S

[58] Field of Search ..... 273/153 S, 153 R, 273/156; 446/99, 376

[56] References Cited

U.S. PATENT DOCUMENTS

| | | | |
|---|---|---|---|
| D. 281,339 | 11/1985 | Hinnen . | |
| 507,215 | 10/1893 | Churchill . | |
| 750,862 | 2/1904 | Keeler . | |
| 908,410 | 12/1908 | Jensen . | |
| 1,920,291 | 8/1933 | Burger . | |
| 4,186,515 | 2/1980 | Ogawa | 446/99 |
| 4,418,914 | 12/1983 | Bauer . | |
| 4,522,402 | 6/1985 | Henry . | |
| 4,526,372 | 7/1985 | Kikis . | |
| 4,836,549 | 6/1989 | Flake | 273/153 S |
| 4,871,173 | 10/1989 | Lammertink . | |
| 4,877,406 | 10/1989 | Wilk | 273/153 S |
| 4,995,846 | 2/1991 | Mariol | 446/376 |
| 5,722,657 | 3/1998 | Cabrera | 273/153 S |

FOREIGN PATENT DOCUMENTS 2121693 1/1984 United Kingdom .

OTHER PUBLICATIONS

"Rubik's Cubic Compendium", Oxford University Press, 1987, pp. 212–215.

*Primary Examiner*—Steven Wong
*Attorney, Agent, or Firm*—Wood, Phillips, VanSanten, Clark & Mortimer

[57] ABSTRACT

A puzzle construction is provided that can be conveniently configured in the form of a humanoid figure. The puzzle includes an upper torso, a lower torso, and five appendages spaced around a periphery of the upper and lower torsos. The puzzle is configured to resemble a humanoid figure, with each of the appendages configured to resemble a humanoid type appendage, such as an arm, a leg, or a head. The upper and lower torsos are rotatably connected so that they may rotate relative to each other about a central, longitudinally-extending axis. The appendages are mounted to the torsos so that they may rotate about a central axis that is perpendicular to the first axis and intersects the first axis. The upper torso is configured to carry three of the appendages when it is rotated and a lower torso is configured to carry two of the appendages when it is rotated.

20 Claims, 6 Drawing Sheets

3-DIMENSIONAL MANIPULATIVE PUZZLE IN THE FORM OF A HUMANOID FIGURE

This application claims the benefit of U.S. provisional application Ser. No. 60/030,014 filed Nov. 1, 1996.

FIELD OF THE INVENTION

The present invention is directed toward amusement devices and puzzles, and more particularly toward three-dimensional, manipulative puzzles or amusement devices which are solved by combinations of movements of the pieces of the puzzle or amusement device.

BACKGROUND OF THE INVENTION

Three-dimensional manipulative puzzles whose object is to arrange characters or color patterns carried on individual pieces in a particular order by translating and/or rotating the pieces in a particular sequence are known.

It is also known to increase the difficulty of solving such puzzles by constructing the puzzle so that movements of individual pieces involve compound actions, such as the movement of one piece causing another piece, or all of the pieces, to move simultaneously.

One well known example of such a puzzle is the "Rubik's Cube". Another known puzzle utilizes a ring that encircles a sphere. The ring has been broken into an even number of pie-shaped pieces that are rotatable as a group about a first axis running through the center of the ring and the sphere. The sphere is split into two equal halves that are rotatable relative to each other about a second axis running through the center of the sphere and perpendicular to the first axis. The puzzle allows for the pie-shaped pieces to be split into two groups having an equal number of pieces, with each group being carried by one of the halves of the sphere for rotation about the second axis.

Typically, such puzzles are in the form of common geometric shapes, such as a cube or a pyramid, or in the form of a combination of geometric shapes, such as a sphere combined with a ring. It is also common for such puzzles to utilize symmetrical pieces, and for the manipulation of such puzzles to cause relative movement between symmetrical groups of pieces. The use of geometrical shapes and symmetrical pieces is dictated, in part, by the mechanisms employed in the puzzles to allow manipulation of the puzzle pieces.

While some such puzzles have proven successful, their appeal may be limited because they typically function only as a puzzle. Additionally, the use of more complicated colored or geometric patterns and especially the use of alpha or numeric characters may make certain of the puzzles too complicated for some users to solve, such as children.

The present invention is directed toward overcoming one or more of the problems discussed above.

SUMMARY OF THE INVENTION

It is an object of the invention to provide an amusement device that can function as a reconfigured doll figure.

It is an object of this invention to provide a manipulative puzzle that may also function as a doll.

It is an object of this invention to provide a three-dimensional manipulative puzzle in the form of a humanoid figure.

It is another object of this invention to provide a puzzle construction that can be conveniently configured in the form of a humanoid figure.

It is a further object of the invention to provide a humanoid-shaped puzzle having puzzle pieces that should be in a certain location and orientation relative to the other puzzle pieces for the puzzle to be solved.

It is yet a further object of the invention to provide a humanoid-shaped puzzle having puzzle pieces configured as discernible parts of a humanoid figure, such as arms, legs, torsos, etc. so that the correct location and orientation of the pieces required to solve the problem will be easily understood by a broad range of users, including children.

In accordance with the present invention, an amusement device is provided that includes a first member configured to simulate a lower torso of a humanoid figure, a second member configured to simulate the upper torso of a humanoid figure, and a plurality of humanoid shaped appendages. The first and second members are connected to rotate around a first axis relative to each other between first and second positions. The appendages are mounted to the first and second members to a) follow movement of the first and second members around the first axis as the first and second members move between the first and second positions, and b) rotate around a second axis that is non-parallel to the first axis.

In one form of the invention, the first and second axes are substantially perpendicular.

In one form of the invention, the first and second axes intersect each other.

In one form of the invention, the first and second members are adapted to carry unequal numbers of the appendages.

In one form of the invention, the device further includes a plurality of carriers, with one carrier attached to each of the appendages. The carriers have end surfaces that abut so that movement of one of the appendages around the second axis requires simultaneous movement of all of the appendages around the second axis.

In one form of the invention, the amusement device includes a first member, a second member, and a plurality of puzzle pieces. The first and second members are connected to rotate relative to each other around a first axis between first and second positions. The plurality of puzzle pieces are mounted to the first and second members for movement together in a pre-determined path relative to the first and second members, with the path lying in a plane that is non-perpendicular to the first axis. The first member is adapted to carry a number N1 of the puzzle pieces, and the second member is adapted to carry a number N2 of the puzzle pieces, where N2 is not equal to N1.

In one form of the invention, the plane of the path is substantially parallel to the first axis.

In one form of the invention, the device includes a first member, a second member, a plurality of puzzle pieces, and a track. The first and second members are connected to rotate relative to each other around a first axis between first and second positions. The first member is configured to simulate the lower torso of a humanoid figure, and the second member is configured to simulate the upper torso of a humanoid figure. Each puzzle piece includes a trolley, and at least one of the puzzle pieces further includes an appendage supported on the trolley and configured to simulate an appendage of a humanoid figure. The track slidably mounts the trolleys to the first and second members and defines a path for the puzzle pieces about the first and second members. The track is divided into a first section that is carried on the first member and a second section that is carried on the second member. The first and second sections are adapted to carry an unequal number of the trolleys.

In one form of the invention, the track is circular about a second axis with the first and second members in the first position. The track has an inner guide surface located at a radius R from the second axis. The first and second members in the first position have a minimum thickness along the second axis that is greater than twice the radius R to retain the trolleys in the track as the first and second members are rotated between the first and second positions.

In one form of the invention, the device includes a first member, a second member, and a plurality of puzzle pieces. The first and second members are connected to rotate around a first axis relative to each other between first and second positions. The first member has a first conical surface, and the second member has a second conical surface cooperating with the first conical surface to at least partially define an interface between the first and second members. The conical surfaces are centered about the first axis and are generally conforming to accommodate rotation of the first and second members about the first axis. The puzzle pieces are mounted to the first and second members to a) follow movement of the first and second members around the first axis as the first and second members move between the first and second positions, and b) move together in a path relative to the first and second members.

In one form of the invention, the first member is adapted to carry a number N1 of the puzzle pieces, and the conical surfaces have a cone angle that is a function of the number N1.

In one form of the invention, the path is circular, the total number of puzzle pieces equals N, and the cone angle equals 360°÷N* N1.

DETAILED DESCRIPTION OF THE PREFERRED EMBODIMENT

While this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1:
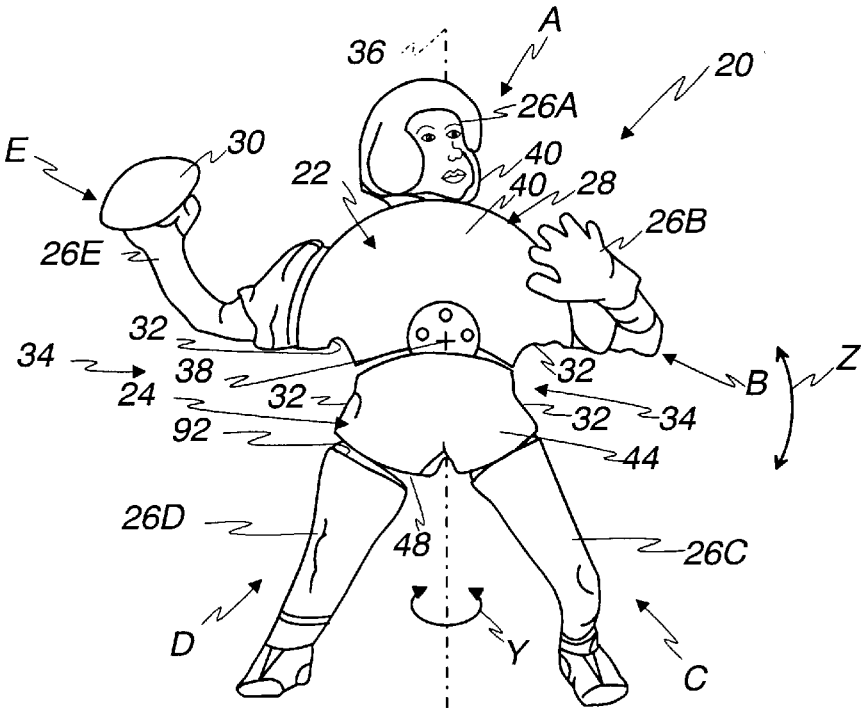
FIG. 1 is a front perspective view of a puzzle embodying the present invention.

FIG. 1 is a perspective view of a three-dimensional puzzle, shown generally at 20, embodying the present invention. The puzzle includes an upper torso 22, a lower torso 24, and five appendages 26 spaced around a periphery 28 of the upper and lower torsos 22, 24. The puzzle 20 is configured in the form of a football player, with one of the appendages 26 formed as the head 26A of a football player wearing a helmet, another of the appendages 26 formed as a left arm/hand 26B of a football player, another of the appendages 26 formed as a left leg/foot 26C of a football player, another of the appendages 26 formed as the right leg/foot 26D of a football player and the last one of the appendages 26 formed as the right arm/hand 26E of a football player holding a football 30 in a passing position. The periphery 28 includes surfaces 32 that define waist sections, shown generally at 34, at the intersection between the upper and lower torsos 22,24. The waist sections 34 are configured so that the upper torso 22 is proportionally bigger than the lower torso 24, thereby providing the puzzle 20 with a human-shaped torso.

As will be explained in farther detail below, the upper and lower torsos 22,24 are rotatably connected so that they may rotate relative to each other about a central, longitudinally-extending axis 36, as indicated by arrow Y. Further, the appendages 26 are mounted to the torsos 22,24, so that they may rotate, as indicated by arrow Z about a central axis 38 that is perpendicular to the axis 36 and intersects the axis 36.

Figure 2:
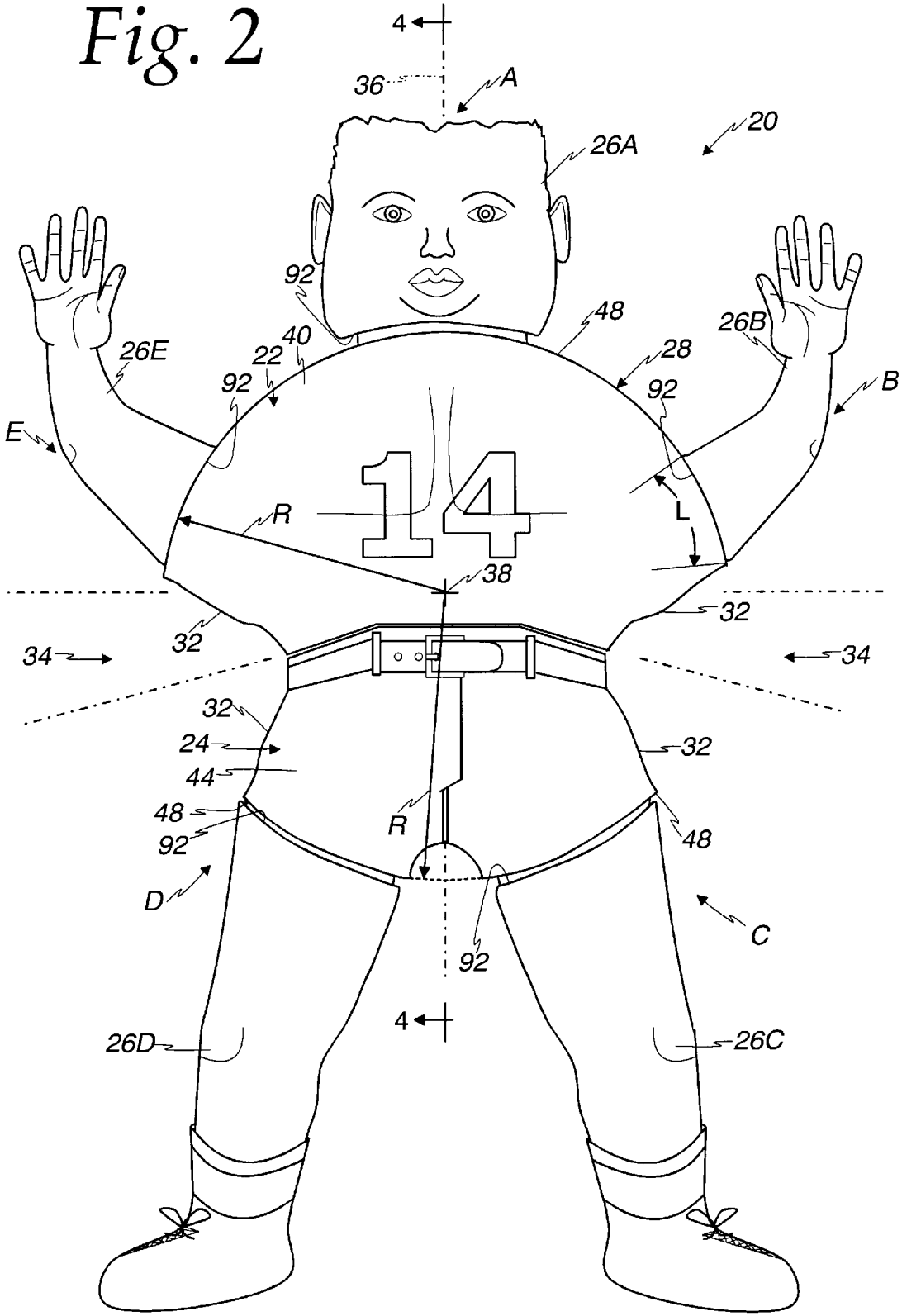
FIG. 2 is a front elevational view of the puzzle shown in FIG. 1, but having several components shown in diagrammatic form.
Figure 3:
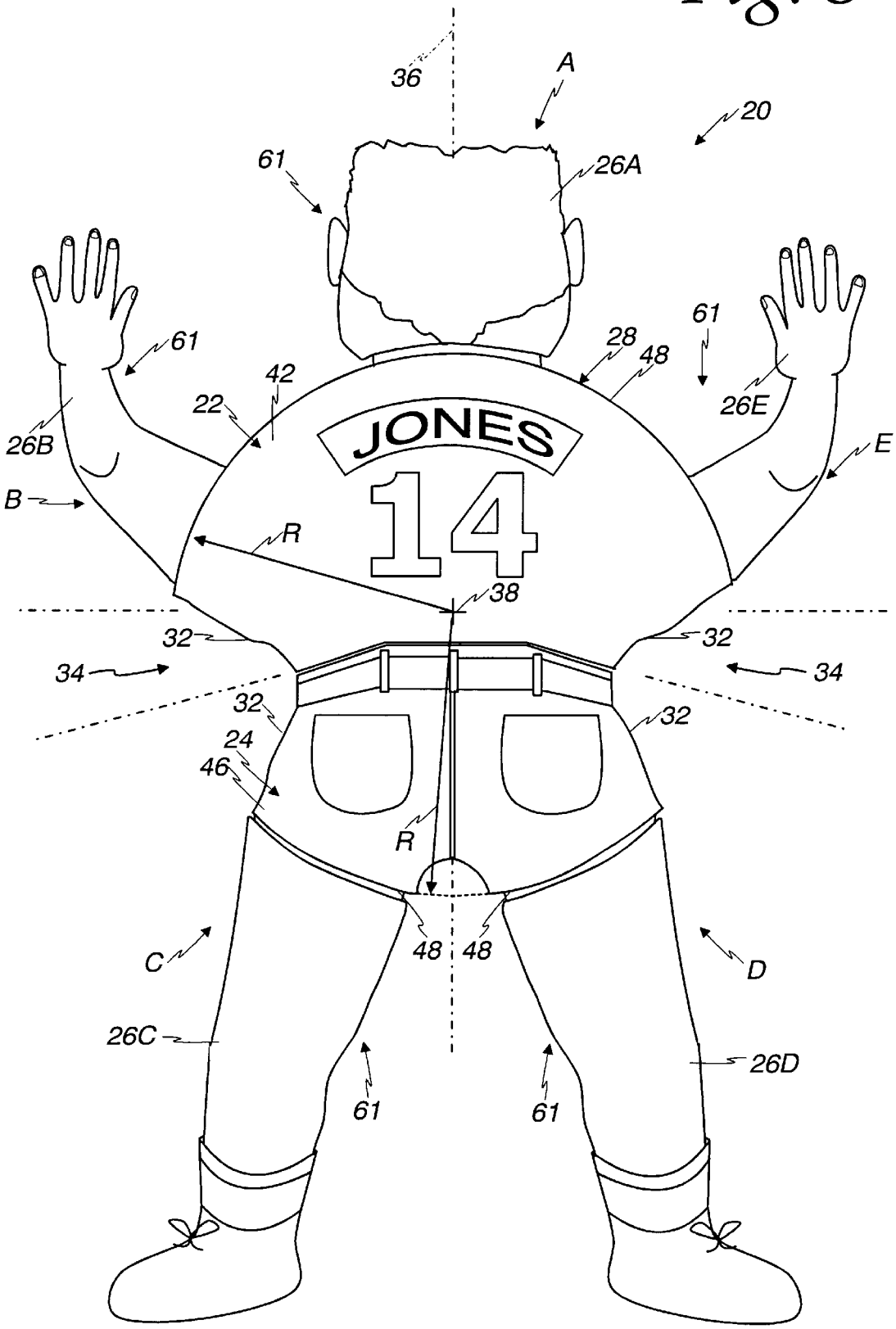
FIG. 3 is a back elevational view of the puzzle shown in FIG. 2.

FIGS. 2 and 3 are front and back elevations, respectively, of the puzzle 20 shown in FIG. 1, but with the appendages shown in diagrammatic form. As best seen in these Figs., the upper torso 22 has a front side 40 configured as the front side of the upper torso or chest of a football player in uniform and a back side 42 configured as the upper torso or back of a football player in uniform. The lower torso 24 has a front side 44 configured as the front of the lower torso of a football player in uniform and a back side 46 configured as the back of the lower torso of a football player in uniform. Thus, the upper and lower torsos 22/24 have a correct front to back orientation relative to each other.

Similarly, as best seen in FIGS. 1, 2 and 3, each of the appendages 26 is configured to have a correct front to back orientation relative to the torsos 22,24 and to each other. In this regard, the correct orientation can be emphasized by configuring each of the appendages 26 so that they extend in a pronounced fashion either forwardly or rearwardly from the torsos 22,24. An example of this is the left arm 26B which extends forwardly from the body. Additionally, each of the appendages 26 has a correct location or station on the upper and lower torsos 22, 24. More specifically, the head 26A belongs at station A on the upper torso 22. The left arm 26B belongs at station B on the upper torso 22. The left leg 26C belongs at station C on the lower torso 24. The right leg 26D belongs at station D on the lower torso 24. And the right arm 26E belongs at station E on the upper torso 22.

As best seen in FIGS. 2 and 3, the periphery 28 of the upper and lower torsos 22,24 adjacent the appendages 26 is defined by surfaces 48 that are generally located at a radius R from the axis 38.

Figure 4:
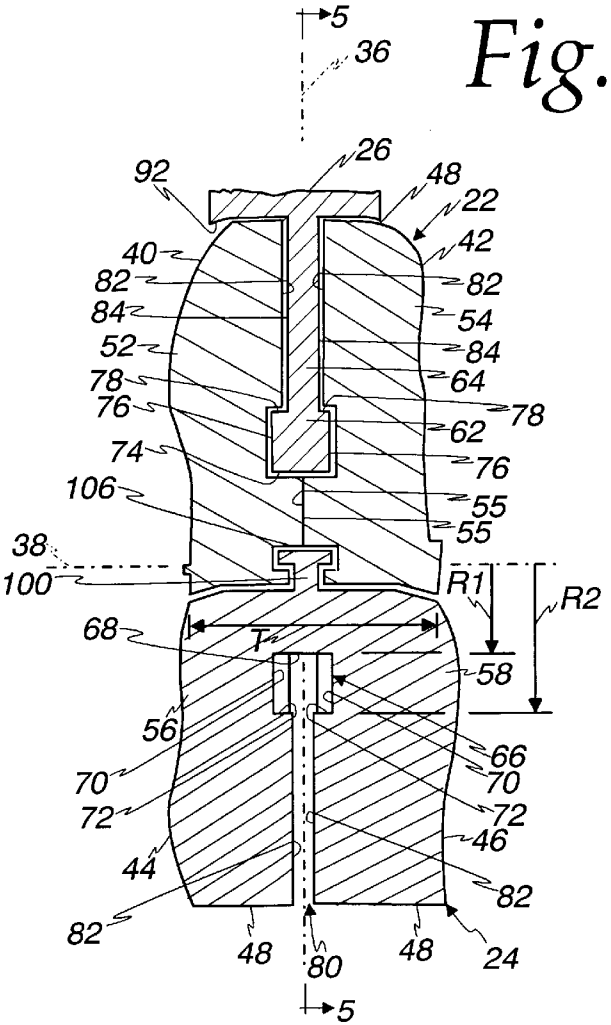
FIG. 4 is a sectional view taken along line 4—4 in FIG. 2 with certain components of the puzzle not shown.

Turning now to the internal details of the puzzle 20, FIG. 4 shows a section view of the upper and lower torsos 22, 24 and one of the appendages 26. The upper torso 22 is a two-piece construction, with a front half 52 and a back half 54. The lower torso 24 is a one-piece construction having a front half 56 and a back half 58. The internal features of the front halves 52 and 56 are substantially identical to the internal features of the back halves 54, 58.

Figure 5:
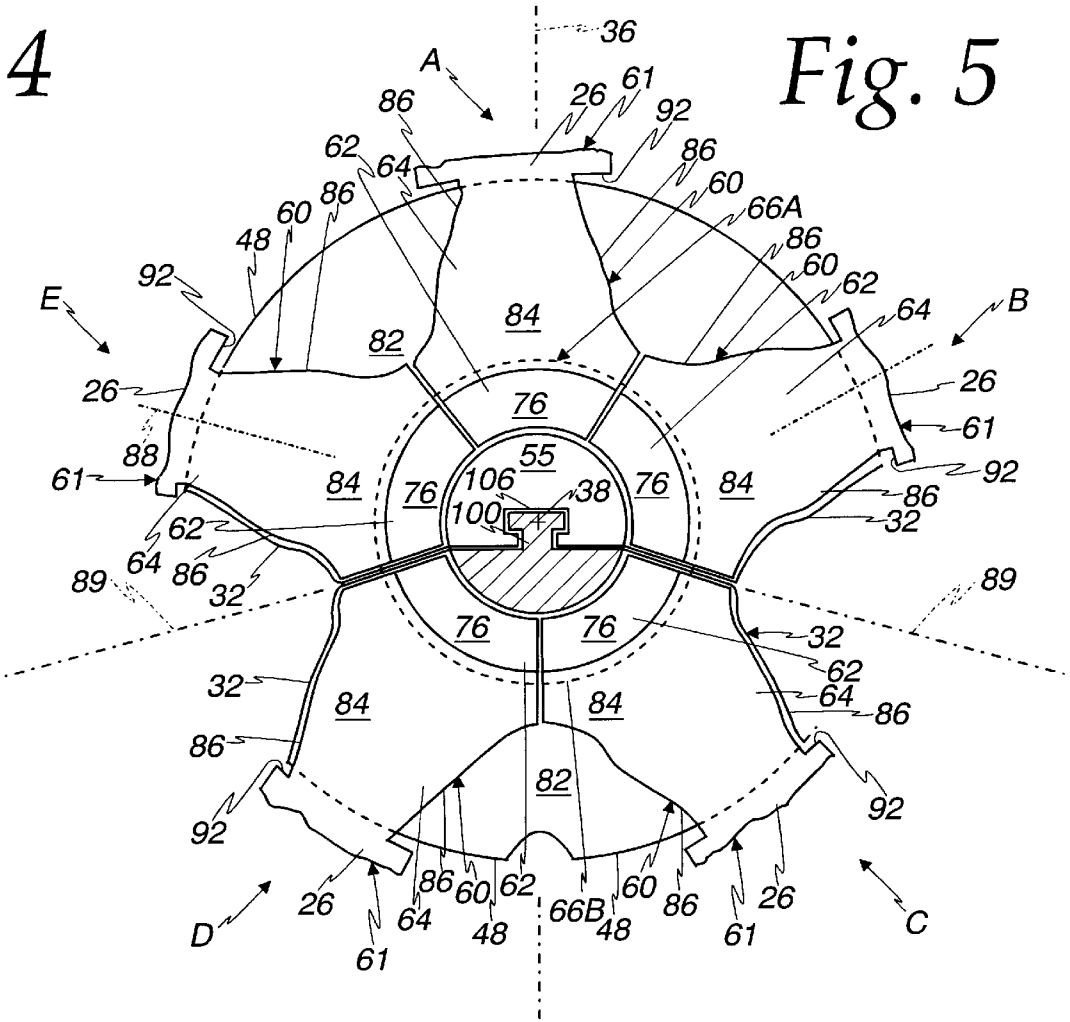
FIG. 5 is a sectional view taken along line 5—5 in FIG. 4.

As best seen in FIG. 5, each of the appendages 26 is mounted to a carrier 60 for rotation about the axis 38. Each of the appendages 26 in combination with its carrier defines a puzzle piece 61. Each of the carriers 60 includes a slide or trolley 62 and a support 64. Each of the supports 64 rigidly connect an appendage 26 to the trolley 62. As best seen in FIGS. 4 and 5, each of the trolleys 62 is slidably mounted in a closed-loop, ring-shaped track 66 that is formed in the upper and lower torsos 22,24. The carriers 60 and the track 66 are symmetrical about a plane perpendicular to the axis 38 and containing the axis 36.

Figures 6, 7, 8:
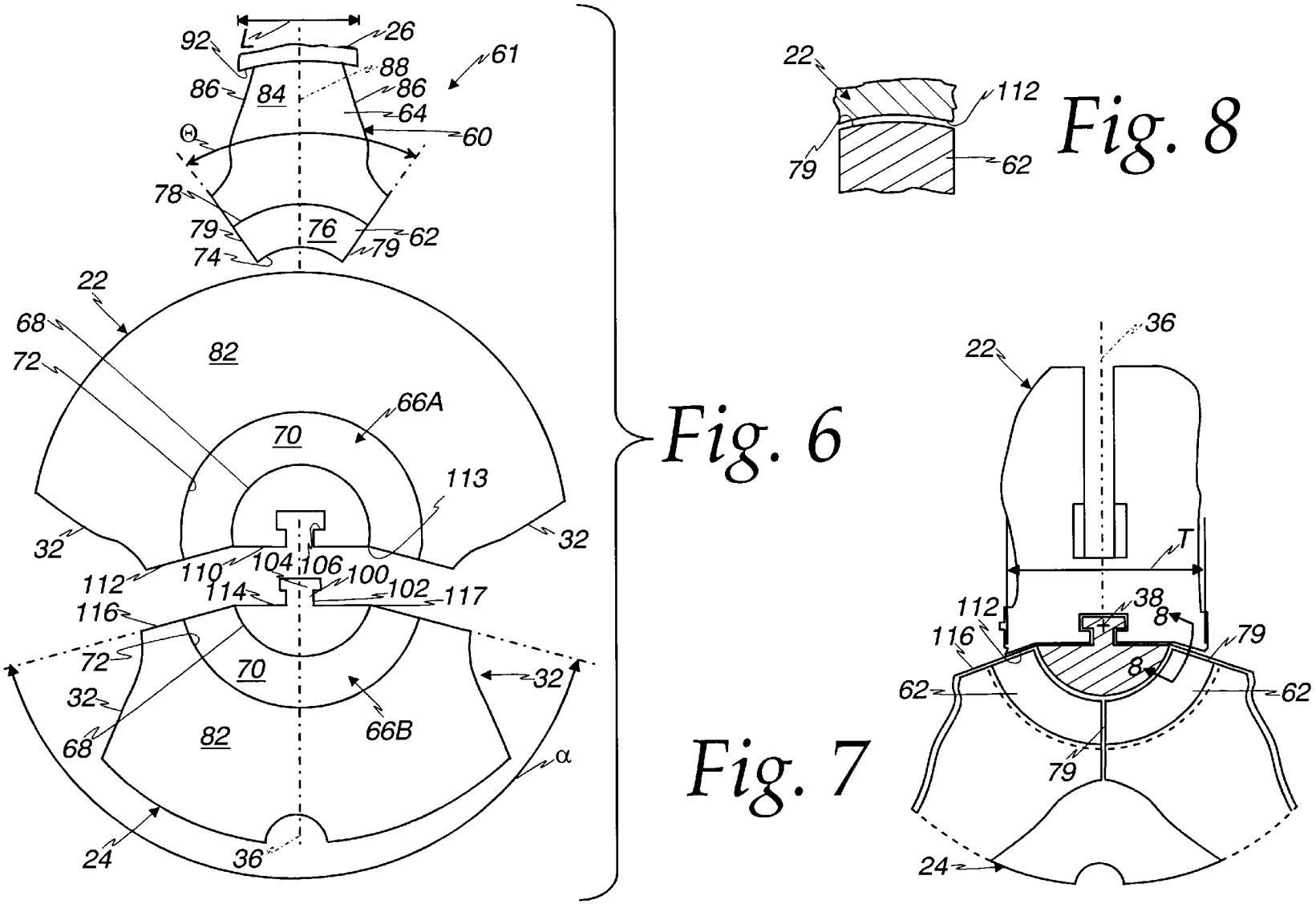
FIG. 6 is an exploded view of selected components from FIG. 5.
FIG. 7 is a view similar to FIG. 5, but having selected components rotated relative to each other.
FIG. 8 is an enlarged view taken from lines 8—8 in FIG. 7.

As best seen in FIGS. 4 and 6, the track 66 is defined by an internal cylindrical guide surface 68 at a radius R1 from the axis 38, a pair of annular axial guide surfaces 70, and a pair of cylindrical outer guide surfaces 72 at a radius R2 from the axis 38. As best seen in FIGS. 5 and 6, the track is divided into two chord sections, with one chord section 66A in the upper torso 22 and one chord section 66B in the lower torso 24. Each of the chord sections 66A,66B is sized to accommodate a different number of the carriers 62 than the other chord sections 66A,66B. In the preferred embodiment, the chord section 66B is sized to accommodate a number N1 of the trolleys 62 that is less than the number N2 of trolleys 62 accommodated by the chord section 66A.

As best seen in FIGS. 4 and 6 each of the trolleys 62 includes a circumferentially extending inner guide surface 74 that conforms to the inner guide surface 68 of the track 66, a pair of axial guide surfaces 76 that conform to the axial guide surfaces 70 of the track 66, and a pair of cylindrical outer guide surfaces 78 that conform to the outer guide surfaces 72 of the track 66. The surfaces 68, 70, 72, 74, 76, 78 cooperate to slidably guide the trolleys 62 around the track 66.

As best seen in FIG. 6, each of the trolleys 62 further includes a pair of end surfaces 79 spaced by an angle 6. The angle θ is determined by the total number N of trolleys 62 in the track 66. The end surfaces 79 on each trolley 62 abut the end surfaces 79 on the immediately adjacent trolleys 62, thereby forcing all of the puzzle pieces to move in the track 66 when any one of the puzzle pieces 61 is moved in the track 66. Thus, θ equals 360° divided by N. Accordingly, for the embodiment shown in FIG. 5, θ=72°=360°/5.

As best seen in FIGS. 4 and 5, each of the supports 64 extends through a generally ring-shaped groove 80 in the upper and lower torsos 22,24. The groove 80 is defined by surfaces 82 in the upper and lower torsos 22,24. Each of the supports 64 includes a pair of substantially flat surfaces 84. It should be appreciated that the surfaces 82 and 84 can cooperate to provide additional support and guidance for the carriers 60 and the appendages 26 as they are rotated about the axis 38.

As best seen in FIG. 6, each of the supports 64 further includes a pair of side edges 86 that are spaced on either side of a line 88 that bisects the carrier 60. While not required, it is preferred that the profiles of the side edges 86 are a mirror image of each other about the bisecting line 88, as seen in FIGS. 5 and 6. Further, as best seen in FIG. 5, the profiles of the surfaces 32 that define the waist sections 34 are a mirror image of each other about bisecting lines 89 and the profiles of the side edges 86 have substantially the same shape as the profile of the surfaces 32. The importance of matching the profiles of the side edges 86 with the profiles of the surfaces 32 will be explained in further detail below.

As best seen in FIGS. 4 and 5, each of the appendages 26 includes a surface 92 adjacent the intersection with the support 64 that has a profile that generally conforms to the profile of the surfaces 48 at each of stations A, B, C, D, and E. Additionally, while not required, it is preferred that the transverse length L of the surfaces 92 be generally equal for each of the appendages 26 and also generally equal to the transverse length of the surfaces 48 in the lower torso 24, as best seen in FIG. 1.

As best seen in FIG. 6, a cylindrical stud 100 extends from the lower torso 24 and includes a cylindrical shaft 102 and a cylindrical head 104. Stud 100 is received in a cavity 106 formed in the upper torso 22 and having surfaces that conform to the stud 100. Half of the cavity 106 is formed in the front half 52 of the upper torso 22 and the other half of the cavity 106 is formed in the back half 54 of the upper torso 22. The stud 100 and the cavity 106 cooperate to rotatably mount the upper torso 22 to the lower torso 24. The head 104 and the conforming surfaces of the cavity 106 cooperate to prevent the upper torso 22 and the lower torso 24 from separating.

It will be appreciated that while the stud 100 is shown as a unitary piece of the lower torso 24, the stud 100 could be a separate piece that is engaged with the lower torso 24 by threads or other suitable means.

As best seen in FIG. 6, the interface between the upper and lower torsos 22 and 24 is defined by planar surface 110 and conical surface 112 on the upper torso 22 and planar surface 114 and conical surface 116 on the lower torso 24. The planar surfaces 110 and 114 and the conical surfaces 112,116 are generally conforming. The planar surfaces 110 and 114 extend perpendicular to the axis 36. The conical surfaces have a cone angle equal to a and are centered about the axis 36, with the apex of the cone angle located at the point of intersection between the axes 36 and 38. The planar surface 110 and the conical surface 112 form a circular intersection 113. The planar surface 114 and the conical surface 116 form a circular intersection 117.

The angle α is dependent upon the number N1 of trolleys 62 held in the lower torso 24 when it is rotated about the axis 36 and on the angle θ separating the surfaces 79 on each of the trolleys 62. More specifically, the cone angle α=θ×N1. Thus, for the embodiment shown in FIG. 5, α=144°=72°×2.

It should be appreciated that the conforming conical surfaces 112 and 116 allow for the upper torso 22 to hold a number N2 of the puzzle pieces 61 that is unequal to a number N1 of the puzzle pieces 61 held in the lower torso 24, while also allowing the upper and lower torsos 22, 24 to rotate relative to each other about the axis 36 without interference between the carriers 60 in the upper torso 22 and the carriers 60 in the lower torso 24 and without interference between the upper and lower torsos 22,24, when the appendages 26 are aligned with the stations A, B, C, D , E. One advantage associated with this feature is that it allows for a three-dimensional manipulative puzzle to be conveniently configured in the form of a doll figure having two appendages (in the form of legs) extending from a lower torso and three appendages (in the form of a head and two arms) extending from an upper torso, as is typical of human and most animal figures. Another advantage of this feature is that it allows for the upper and lower torsos 22, 24 to be relatively proportioned and shaped so that they closely resemble the natural shape of a humanoid torso, thereby increasing the aesthetic appeal of the puzzle 20.

It should be appreciated that, because of the symmetry of the track 66 and the trolleys 62, they are functional regardless of whether the upper and lower torsos are in a first position with their front sides 40, 44 aligned and facing forward or in a second position with their front sides 40, 44 aligned with the back sides 42,46 of the opposite torso.

It should be appreciated that, prior to rotating the upper and lower torsos 22, 24 relative to each other, the end surfaces 79 of the trolleys 62 adjacent the interface between the upper and lower torsos 22, 24 must be aligned with the conical surfaces 112, 116. The conforming profiles of the side edges 86 and the surfaces 32 allow a puzzle operator to easily obtain this alignment by placing his fingers within the waist sections 34 and using his fingers to rotate the carriers 60 in the track 66 until the conforming profiles of the side edges 86 and the surfaces 32 are in alignment, thereby automatically insuring that the end surfaces 79 are aligned with the conical surfaces 112, 116.

While the conforming profiles of the side edges 86 and the surfaces 32 provide a desirable feature, it should be appreciated that the profiles of the side edges 86 and the surfaces 32 may be formed so that they do not conform and, further, so that they are not mirror images about their bisecting lines 88, 89.

As best seen in FIG. 4, the upper and lower torsos 22,24 have a thickness T at their intersection. As best seen in FIG. 7, it is preferred that the thickness T be greater than the radius R1 of the inner guide surface 68 of the track 66, to thereby insure that the trolleys 62 are retained within the track 66 when the upper and lower torsos 22, 24 are rotated relative to each other as shown in FIG. 7. In the embodiment shown in FIGS. 4 and 7, the thickness T is approximately equal to (R1+R2).

As best seen in FIG. 8, the end surfaces 79 of the trolleys 62 are convex and generally conform with the conical surface 112 in the upper torso 22, thereby eliminating any interference between the surfaces 79 and 112 when the upper and lower torsos 22 and 24 are rotated relative to each other.

While it is highly preferred to have only five carriers 60, each associated with one appendage 26, the invention contemplates alternate embodiments. One example of such an alternate embodiment would include a pair of puzzle pieces 61 in the form of blank carriers 60 that terminate below the surfaces 48 of the upper and lower torsos 22,24 and do not have any appendages 26. Thus, the blank carriers 60 would be essentially hidden in the torsos 22,24. Accordingly, the location of the blank carriers 60 within the puzzle 20 would not be easily determined by the operator of the puzzle 20, thereby possibly increasing the difficulty of the puzzle 20. The trolleys 62 of the blank carriers 60 could be spaced between the trolley 62 of the head 26A and the arms 26B, 26E in the solved position. In their simplest form, each of the carriers 60 would consist only of a trolley 62 and would not include a support 64. In this embodiment, the lower torso 24 would hold two of the trolleys 62. Thus, N1=2, N2=5, and $\theta$ would be approximately 51.42°=360°/7 and $\alpha$=102.84°=2×51.42°.

It should be noted that having a number of carriers 62 greater than five increases the difficulty of forming the puzzle 20 into an aesthetically pleasing humanoid figure.

To initially assemble the puzzle 20, the trolleys 62 of the left and right leg puzzle pieces 61 are slid circumferentially into the track chord section 66B in the lower torso 24. The lower torso 24 is then connected to the upper torso 22 by inserting the stud 100 into the cavity 106. Next, the trolleys 62 of the head and left and right arm puzzle pieces 61 are placed into the track chord section 66A in tile back half 54 of the upper torso 22. Finally, the front and back halves 52, 54 of the upper torso 24 are attached at their mating surfaces 55 using suitable fasteners and/or a suitable adhesive. Preferably, the front and back halves 52, 54 are permanently attached to their mating surfaces 55 to prevent a puzzle operator from disassembling the puzzle 20.

It should be noted that the upper torso 22 could be formed as a single piece and the stud 100 could be formed as a cylindrical snap fastener. In this situation, three of the appendages 26 would be loaded into the upper torso 22 and two of the appendages 26 would be loaded into the lower torso 24. The snap fastener/stud 100 would then be snapped into a conforming cavity 106 in the direction of the axis 36.

It should be appreciated that all of the clearances illustrated in the Figures between the components of the puzzle 20 are for purposes of illustration only and that, in the preferred form, the clearances would be only those required for the puzzle to be operated smoothly.

The upper and lower torsos 22,24 and the puzzle pieces 61 may be formed from any materials that provide a sufficient rigidity to allow operation of the puzzle 20. Preferably, each of the lower torso 22, the upper halves 52, 54 of the upper torso 24, and the puzzle pieces 61 are molded or cast as individual pieces from a suitable plastic, composite, or metal. However, it should be appreciated that any of the components of the puzzle 20 may be formed from a multi-piece construction. For example, the appendages 26 could be formed as separate pieces from the carriers 60 and then attached to the carriers 60. By way of further example, the track chord sections 66A and 66B could be formed as separate pieces which are then joined with the upper and lower torsos 22, 24.

Figure 9:
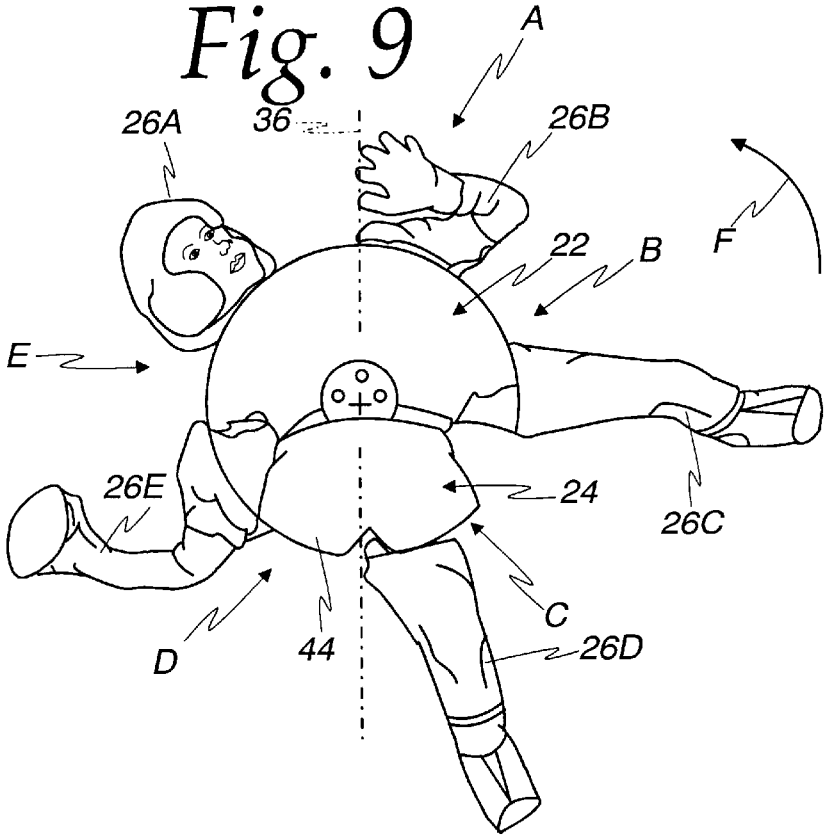
FIGS. 9–11 are front elevational views of the puzzle shown in FIG. 1, with several of the components of the puzzle rotated.
Figure 10:
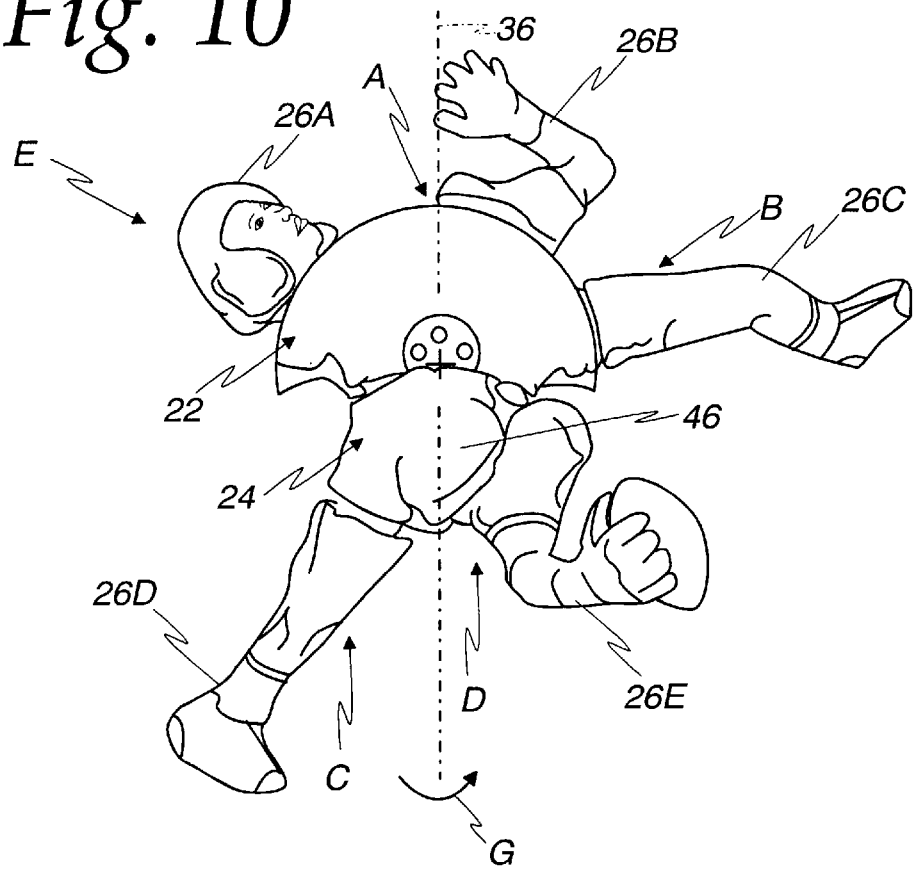
Figure 11:
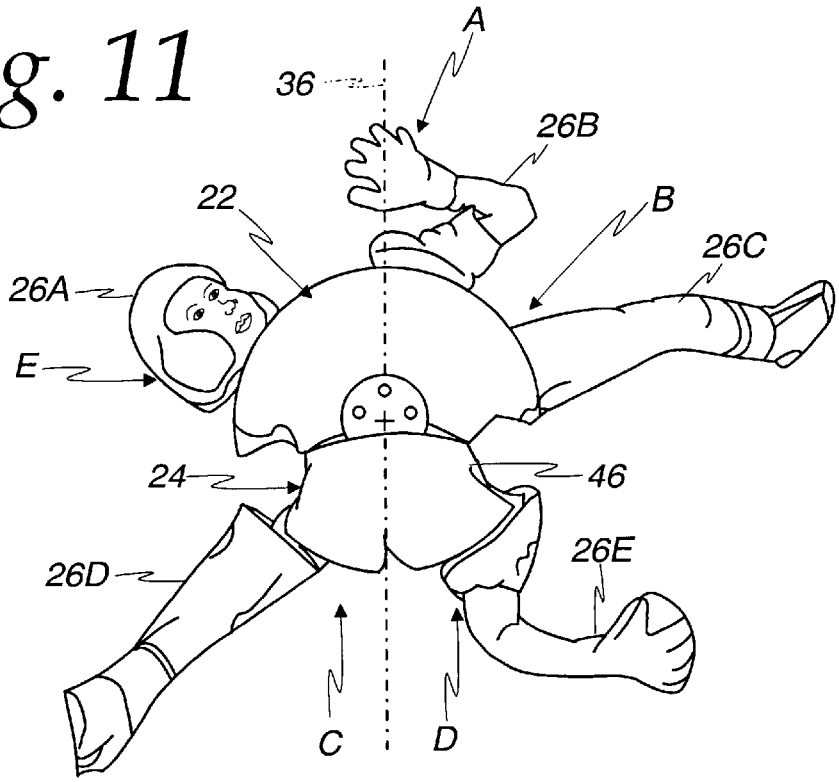

As noted earlier, each of the puzzle pieces 61 has an appropriate station or location A, B, C, D or E on the puzzle 20 and an appropriate front to back orientation on the puzzle 20. To scramble or unscramble the puzzle 20, the puzzle pieces 61 may be rotated about the axis 38 until they are aligned with one of the locations A, B, C, D, or E, and then the upper and lower torsos 22,24 may be rotated about the axis 36 relative to each other to change the sequence of the puzzle pieces 61 in the track 66. This operation is illustrated in FIGS. 9–11. In FIG. 9, the puzzle pieces 61 are being rotated in a counterclockwise direction, as indicated by arrow F, about the axis 38 until the head appendage 26A is aligned with station E, the right arm appendage 26E is aligned with station D, the right leg appendage 26D is aligned with station C, the left leg appendage 26C is aligned with station B, and the left arm appendage 26B is aligned with station A. As seen in FIG. 10, the lower torso 22 is then rotated, as indicated by the clockwise arrow G, until the upper and lower torsos 22,24 and the track chord sections 66A and 66B are realigned, as seen in FIG. 11. This places the right arm appendage 26E and the right leg appendage 26D out of sequence on the puzzle 20 and in the wrong front to back orientation with the other appendages 26.

It should be appreciated that the puzzle 20 is shown configured as a football player for illustration only and that the invention anticipates, at a minimum, that the puzzle can be configured to resemble any humanoid figure having five appendages.

It should be understood that in this application the term humanoid figure includes figures based on an alien or animal character.

Thus it can be seen, that the present invention provides a puzzle 20 that can be conveniently configured in an aesthetically pleasing form of a humanoid figure with appropriately proportioned, shaped and oriented body parts that are easily discernible and understood by a puzzle operator, including a young child.

Still other aspects, objects, and advantages of the present invention can be obtained from a study of the specification, the drawings, and any appended claims.

I claim:

1. An amusement device comprising:

a first member and a second member that are connected to rotate around a first axis relative to each other between first and second positions, the first member configured to simulate the lower torso of a humanoid figure, the second member configured to simulate the upper torso of a humanoid figure; and a plurality of humanoid shaped appendages mounted to the first and second members to a) follow movement of the first and second members around the first axis as the first and second members move between the first and second positions and b) rotate around a second axis that is non-parallel to the first axis.

2. The device of claim 1 wherein the first and second axes are substantially perpendicular.

3. The device of claim 1 wherein the first and second axes intersect each other.

4. The device of claim 1 wherein the first and second members are adapted to carry unequal numbers of the appendages.

5. The device of claim 1 wherein one of the appendages is configured to simulate a head, one of the appendages is configured to simulate a right arm, one of the appendages is configured to simulate a left arm, one of the appendages is configured to simulate a right leg, and one of the appendages is configured to simulate a left leg.

6. The device of claim 1 further comprising a plurality of carriers, one carrier attached to each of the appendages, the carriers having end surfaces that abut so that movement of one of the appendages around the second axis requires simultaneous movement of all of the appendages around the second axis.

7. The device of claim 1 wherein the first and second members are rotated 180° between the first and second positions, and the appendages can rotate around the second axis only with the first and second members in the first and second positions.

8. An amusement device comprising:

a first member and a second member that are connected to rotate relative to each other around a first axis between first and second positions;

a plurality of puzzle pieces mounted to the first and second members for movement together in a predetermined path relative the first and second members, the path lying in a plane that is non-perpendicular to the first axis; and wherein the first member is adapted to carry a number N1 of the puzzle pieces;

the second member is adapted to carry a number N2 of the puzzle pieces, where N2 is not equal to N1.

9. The device of claim 8 wherein the plane of the path is substantially parallel to the first axis.

10. The device of claim 8 wherein the path is circular about a second axis that is substantially perpendicular to the first axis.

11. The device of claim 8 wherein at least one of said first and second members is configured to simulate a humanoid torso.

12. The device of claim 8 wherein at least one of the puzzle pieces is configured to simulate an appendage of a humanoid figure.

13. An amusement device comprising:

a first member and a second member that are connected to rotate relative to each other around a first axis between first and second positions, the first member configured to simulate the lower torso of a humanoid figure, the second member configured to simulate the upper torso of a humanoid figure;

a plurality of puzzle pieces, each piece comprising a trolley, at least one of the pieces further comprising an appendage supported on the trolley and configured to simulate an appendage of a humanoid figure; and a track slidably mounting the trollies to the first and second members, the track defining a path for the puzzle pieces about the first and second members, the track divided into a first section that is carried on the first member and a second section that is carried on the second member, the first and second sections adapted to carry unequal numbers of the trolleys.

14. The device of claim 13 wherein the total number of puzzle pieces equals N, the first section is adapted to carry a number N1 of the puzzle pieces, and the second section is adapted to carry a number N2=N−N1 of the puzzle pieces.

15. The device of claim 13 wherein the first and second members are each have a front surface configured to simulate the front of a humanoid figure and a back surface configured to simulate the back of a humanoid figure, and the at least one of the pieces is configured to have a correct orientation relative to the front and back surfaces of the first and second members.

16. The device of claim 13 wherein:

the track is circular about a second axis with the first and second members in the first position, the track having an inner guide surface located at a radius R from the second axis; and the first and second members in the first position have a minimum thickness along the second axis that is greater than twice the radius R to retain the trolleys in the track as the first and second members are rotated between the first and second positions.

17. An amusement device comprising:

a first member and a second member that are connected to rotate around a first axis relative to each other between first and second positions, the first member having a first conical surface and the second member having a second conical surface cooperating with the first conical surface to at least partially defining an interface between the first and second members, the conical surfaces being centered about the first axis and generally conforming to accommodate rotation of the first and second members about the first axis; and a plurality of puzzle pieces mounted to the first and second members to a) follow movement of the first and second members around the first axis as the first and second members move between the first and second positions and b) move together in a path relative to the first and second members.

18. The device of claim 17 wherein:

the first member is adapted to carry a number N1 of the puzzle pieces; and the conical surfaces have a cone angle that is a function of the number N1.

19. The device of claim 18 wherein the path is circular, the total number of puzzle pieces equals N, and the cone angle equals 360°÷N * N1.

20. The device of claim 17 wherein at least one of said first and second members is configured to simulate a humanoid torso.

* * * * *